United States Patent [19]

Phillips

[11] 4,205,588

[45] Jun. 3, 1980

[54] METHOD AND MATERIAL FOR FUZE RENDER SAFE PROCEDURE

[75] Inventor: Ralph O. Phillips, Londonderry, Vt.

[73] Assignee: The United States of America as represented by the Secretary of the Navy, Washington, D.C.

[21] Appl. No.: 741,203

[22] Filed: Jun. 10, 1958

[51] Int. Cl.[2] ..... F42C 33/06

[52] U.S. Cl. ..... 89/1 A; 260/18 R

[58] Field of Search ..... 18/59 E; 86/1.5; 89/1, 89/1 R, 1 A; 260/2.5, 77.5 A; 102/1

[56] References Cited

U.S. PATENT DOCUMENTS

| | | | |
|---|---|---|---|
| 2,404,441 | 7/1946 | Hopkins | 89/1 R |
| 2,632,211 | 3/1953 | Trigg | 220/81 R X |
| 2,716,778 | 9/1955 | Beare | 264/171 |
| 2,787,601 | 4/1957 | Detrick et al. | 260/18 TN X |
| 2,788,335 | 4/1957 | Barthel | 521/159 |

*Primary Examiner*—David H. Brown

*Attorney, Agent, or Firm*—R. S. Sciascia; A. L. Branning

EXEMPLARY CLAIM

1. The method of rendering immobile the movable or potentially movable portions of the casing-enclosed activation element of an explosive device which comprises preparing a sufficient quantity of a prepolymeric material in a pressure vessel by reacting an arylene diisocyanate with an amount of a fatty acid triglyceride having a hydroxyl number not materially less than 49, such that the ratio of the number of hydroxyl groups contained in the fatty acid triglyceride to the number of isocyanate groups in the arylene diisocyanate is greater than 0.45 to 2 but not more than 0.95 to 2, mixing with the prepolymeric material water in the ratio of one mole of water per two isocyanate groups, and connecting the pressure vessel to the interior of the casing-enclosed activation element whereby the material in the pressure vessel foams and expands, the pressure of the forming foam causing its injection therein filling all voids in the casing-enclosed activation element and allowing the material to cure to a rigid foam.

4 Claims, 2 Drawing Figures

METHOD AND MATERIAL FOR FUZE RENDER SAFE PROCEDURE

Figure 1:
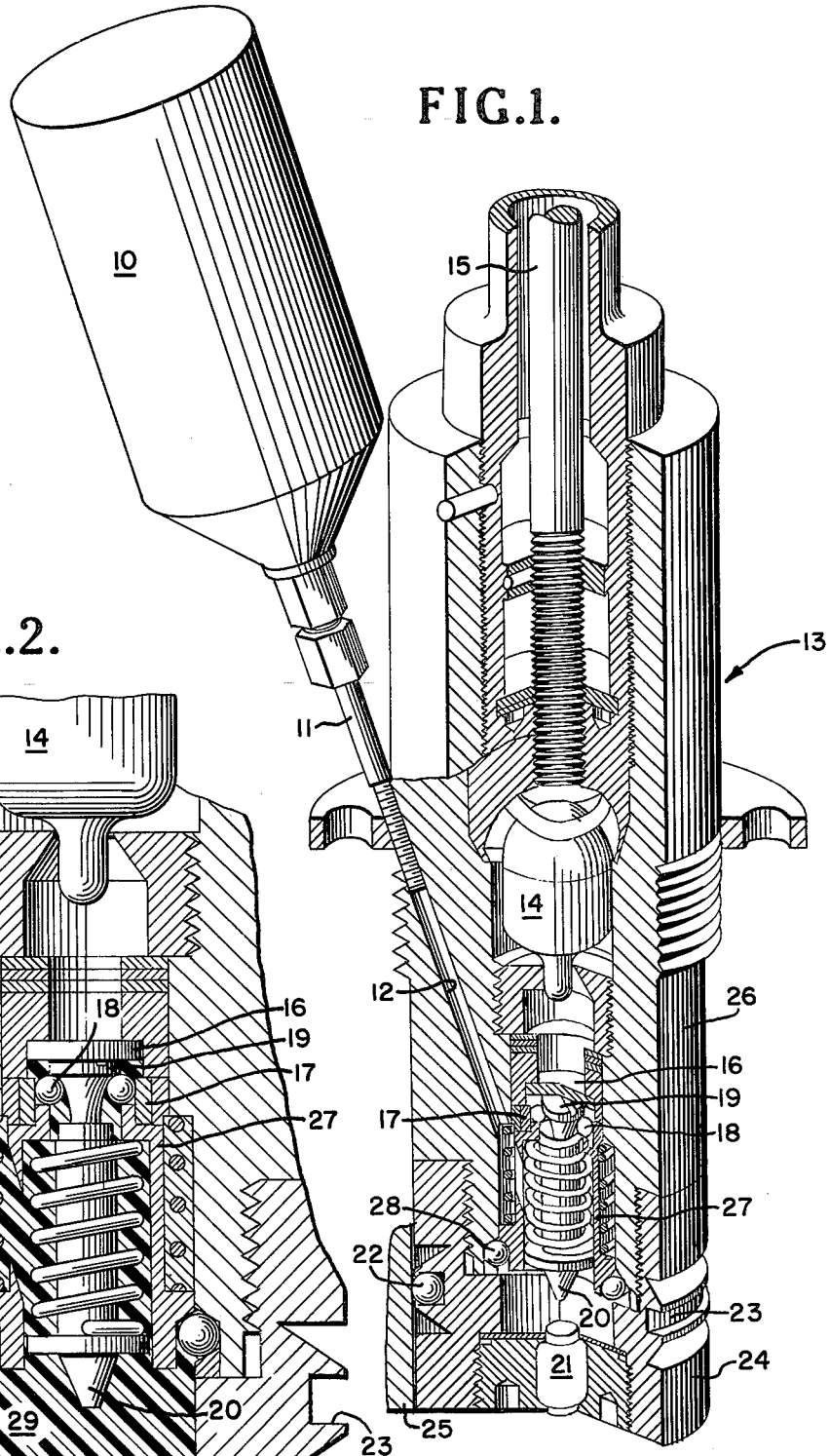

This invention relates to a method of rendering immobile the movable or potentially movable portions of mechanisms which are inaccessible because of the outer casing with which they are provided or because of their location. More specifically, the invention relates to a method of rendering safe the activating mechanisms of bombs, shells, mines and the like which are provided with antiwithdrawal devices without undue risk to the ordnance disposal personnel involved.

Removal and disassembly of the firing mechanisms of explosive devices such as bombs, shells, mines, torpedoes and the like has heretofore required that highly trained personnel expose themselves for relatively long periods of time, usually under extremely hazardous conditions, with the ever present possibility that the firing mechanism will function, either because of the manner in which it was designed to operate or as a result of disassembly operation, causing the explosive device to operate. In addition many firing mechanisms in modern explosive devices are provided with antiwithdrawal devices which cause the firing mechanisms to operate when any attempt is made to remove the firing mechanism from the explosive device.

Many different methods have been employed in an effort to decrease the probability that such firing mechanisms will operate as an attempt is being made to deactivate the mechanism or to remove it from the explosive device which it is designed to explode. One of these methods is to drill a hole through the casing of the firing mechanism and to inject through this hole into the internal cavities of the firing mechanism a quick-solidifying mixture such as Plaster of Paris, alcohol-ether cement solutions, solutions of gum shellac and the like which upon hardening will prevent the movement of the movable or potentially movable portions of the firing mechanism. The use of such materials has not been found satisfactory, however, since they all require the use of a hydraulic injector pump to force the material into the cavities of the firing mechanisms and the peculiar properties of each of these materials severely limits its use. For example, thick solutions of gum shellac or cement are too viscous to be forced into the small openings in such firing mechanisms whereas thin solutions take too long to solidify inside the mechanism to be of practical use.

In accordance with the present invention the necessity for using a hydraulic injector pump is obviated by the use of a foaming mixture which creates its own pressure, which is of sufficiently low viscosity to force itself into all the openings of a firing mechanism and which is sufficiently self-solidifying to effectively and expeditiously decrease the probability of operation of the firing mechanisms into which it is injected.

It is, therefore, an object of the present invention to provide a simple and effective method of immobilizing the movable and potentially movable elements of a mechanism within a casing.

Another object is to provide a simple and effective method of rendering safe the firing mechanisms of explosive devices which is quick and does not require the use of complicated pressure apparatus.

A further object is to provide a method of rendering safe the firing mechanisms of explosive devices which is simple and does not require the services of highly trained personnel.

Other objects and the attendant advantages of the invention will become apparent to those skilled in the art as the invention is disclosed in the following detailed description.

The above objects are achieved according to the process of the invention by foaming in a container a resin composition which foams and cures at room temperatures resulting in a rigid foam product having a volume greater than that of the original composition. The container holding the foaming resin composition is connected to a hole previously drilled through the casing of the firing mechanism to be deactivated. The foaming composition as it expands, forces itself into the drilled hole and then into all the small openings and indentations in the cavities of the firing mechanism, surrounds the various components of the firing mechanism in the cavity, and cures, hardening to a rigid mass so as to prevent the movement of those components.

Figure 2:
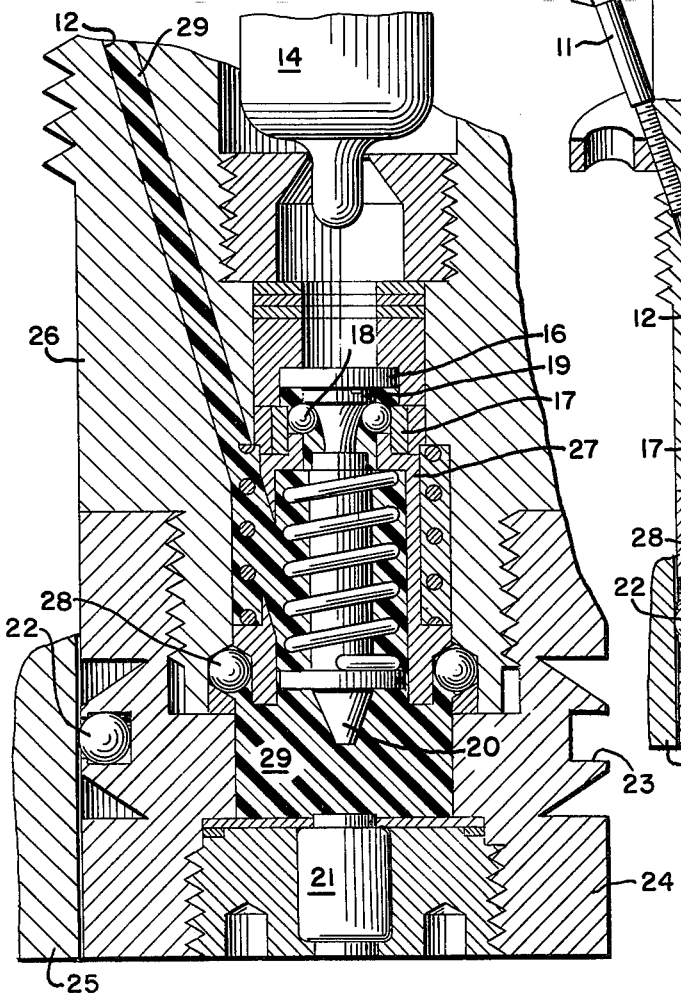

FIG. 1 of the drawing illustrates a typical method of injecting a foaming resin composition into the cavities of a typical chemical delay fuze of a bomb; and FIG. 2 illustrates a fuze of the same type as FIG. 1, somewhat enlarged and partially broken away in which the cavities are filled with the cured foam.

The resin compositions which may be used in the method of the invention are those resin compositions which are formed from compounds which upon mixing, foam fairly rapidly and upon foaming expand to a volume considerably greater than the volume of the unfoamed composition. For simplicity the resin composition should be a two component system. It should be of sufficiently low viscosity that it will mix well and rapidly, and flow through the small openings in the firing mechanisms at temperatures from −30° F. to 160° F. The components should have a long storage life and not react with the containers in which they are stored. The foaming composition should expand rapidly and uniformly at a pressure sufficient to fill the cavities of the firing mechanism adequately and should not be appreciably chemically altered by the chemicals, such as acetone, commonly employed in fuzes. The resin composition must be self curing and the resulting foam must be tough, having sufficient physical strength for the purpose employed and yet not be too brittle. The resulting foam should adhere well to metal and have good dielectric properties.

Any composition having the above characteristics may be employed in the process of the invention. However, the compositions, such as are described in U.S. Pat. No. 2,788,335 to E. Barthel, Jr. dated Apr. 9, 1957 as well as those described in U.S. Pat. No. 2,787,601 to S. R. Detrick et al, dated Apr. 2, 1957, which produce rigid foams have been successfully employed in the process of the invention. In the compositions described in these patents, an isocyanate rich resin material reacts with water liberating carbon dioxide and forming polyures linkages which, upon further reaction with the excess isocyanates, crosslink the resin. As the reaction continues, the viscosity of the mix increases, while the entrapped carbon dioxide swells the mass. Apparent termination occurs when the concentration of isocyanate is exhausted. The amount of bubbling can be controlled by the amount of isocyanate and other chemical modifying agents, thus giving products of varying but controllable and uniform densities. Additionally, by varying the initial reactants, foams varying from soft flexible materials to hard rigid materials can be prepared. The reaction between the isocyanate rich resin material and the water is exothermic producing a rapid cure.

As employed in the process of the invention these chemicals may be mixed in any suitable container and may be mixed by hand or by mechanical agitation, whichever is preferable. Whatever container is employed, there should be allowed sufficient room for the composition to be agitated and to start to foam. Generally a container which is two thirds full gives ample room for this purpose.

Temperature is not generally important but the ingredients must be maintained at least at a temperature at which they can be conveniently mixed.

When utilizing compounds of the type described above it is possible to use a one-shot system in which all the chemicals are mixed at one time or a two-shot system in which the isocyanate is reacted with the hydroxy containing compound to obtain what is called a prepolymer which is later mixed with water or water and additional isocyanate to complete the reaction and form the foam. The one-shot system has the disadvantages of being viscous and hard to mix and requiring several containers for the chemicals while it has the advantage of a higher exotherm. The two-shot system has the disadvantage of a lower exotherm but the prepolymerized resin is thinner and mixes more easily. In addition, in the two shot system the containers may be limited to two.

In accordance with the invention when the ingredients are mixed and foaming begins, the container is connected in a suitable manner to an opening in the casing of the device to be inactivated. As the mixture reacts, it increases in volume with the release of the carbon dioxide, the resulting foam forces itself out of the container into the interior cavities of the device, fills those cavities and cures forming a rigid foam around the mechanism within the cavities.

Any suitable type of container may be employed in the process of the invention. High pressure type metal cans such as are commonly employed to contain material under pressure have been successfully employed. Also useable are flexible containers of pliable material into which have been inserted ampoles containing the water and catalyst which may be broken by kneading the container by hand to break the ampoule and mix the components.

Whatever type of container is employed, however, it must be provided with a suitable means such as a nozzle with a means such as self-topping threads to permit relatively airtight conjunction between the container and a hole in the casing of the device to be inactivated.

The casing of the mechanism may be perforated in any suitable well known manner such as by drilling as is well known in the art using a jig drilled at the proper angle to reach the cavity desired.

In order to more fully illustrate the process of the invention the process is described utilizing a specific foaming composition in conjunction with a description of the use of such composition in the manner shown in the accompanying drawing. This example is, however, intended to be illustrative only and not to limit the invention in any manner.

EXAMPLE

A prepolymer was prepared in accordance with the directions given in U.S. Pat. No. 2,787,601, previously cited, for the preparation of prepolymer A. 47 grams of the prepolymer and 3 grams of finely divided magnesium stearate were mixed in a high pressure container 10 such as is illustrated in FIG. 1 of the drawing. To the mixture in container 10 was added a mixture of 1 gram of water and 0.9 grams of cyclohexylamine with agitation. After agitation for about 30 seconds the mixture started to foam and assumed an appearance similar to whipped cream. The large end of the externally threaded self-topping needle 11 was then screwed into the opening of the container 10. As the mixture in the container started to expand, the narrow end of the needle 11 was threaded into the hole 12 drilled in the side of fuze 13 by means of a jig which slipped over the upper end of the fuze 13. The jig used is not shown as this type of jig is well known to those skilled in the art and does not constitute part of this invention.

The fuze 13 illustrates a chemical delay type fuze such as are commonly employed as base fuzes in bombs. The fuze 13 is provided with a glass ampoule 14 filled with an alcohol-acetone solution. When dropped in a bomb, vanes [not shown] on the end of the arming stem 15 cause the arming stem to rotate thus threading down on the glass ampoule 14 causing the ampoule 14 to break. The acetone-alcohol solution released thusly from the ampoule 14 acts on the celluloid disc 16 and ring 17 which retains the firing pin retaining balls 18. As the acetone-alcohol solution acts on the celluloid ring 17 the retaining balls 18 are forced out by the head 19 of the spring loaded firing pin 20 which is thus released to strike the detonator 21.

If an attempt to withdraw this type fuze 13 is made after it is installed, the anti-withdrawal locking ball 22 rides into the shallow portion of groove 23 and locks the lower fuze body 24 to the adapter booster 25. Further turning of the fuze 13 merely unthreads the upper fuze body 26 from the lower part 24, allowing the spring loaded firing pin sleeve 27 to force the sleeve balls 28 into the separation driving both the sleeve 27 and firing pin 20 towards the detonator 21. Thus an attempt to remove the fuze 13 activates the fuze even if it is in an unarmed condition prior to the attempt at removal.

The reacting composition in the container 10 created its own pressure, forced itself out of the container 10 through the needle 11 and hole 12 into the interior of the fuze 13 filling all the cavities of the fuze 13. Inside the fuze 13 the foaming composition, providing its own heat, cured itself within five minutes to a rigid foam 29 as shown in FIG. 2. This prevented the movement of the firing pin 20 against the detonator 21 when the fuze was withdrawn from its position in the bomb.

It is to be understood, however, that the invention is not limited to the specific composition described above, nor to the compositions disclosed in the patents cited above. The invention also, is not limited to the use of prepolymers but may employ a two-shot system as previously described. Any suitable resin composition which has, to a reasonable degree, the characteristics previously set forth may be employed in the method of the invention as will be readily understood by those skilled in the art. Also any suitable organic polyisocyanate may be employed in these compositions. However, meta toluene disocyanate is preferred because of quality of the foams resulting therefrom.

From the foregoing it may be seen that there has been provided a simple, efficient method of rendering immobile the movable or potentially movable portions of otherwise inaccessible mechanisms such as the activating mechanisms of bombs, shells, mines, torpedoes and the like which permits the disarming of such explosive devices without unduly prolonging the risk to the highly trained ordnance disposal personnel engaged in the disarming operation. It is to be understood, however, that the invention may be practiced otherwise than as specifically described within the scope of the following claims.

What is new and desired to be secured by Letters Patent of the United States is:

1. The method of rendering immobile the movable or potentially movable portions of the casing-enclosed activation element of an explosive device which comprises preparing a sufficient quantity of a prepolymeric material in a pressure vessel by reacting an arylene diisocyanate with an amount of a fatty acid triglyceride having a hydroxyl number not materially less than 49, such that the ratio of the number of hydroxyl groups contained in the fatty acid triglyceride to the number of isocyanate groups in the arylene diisocyanate is greater than 0.45 to 2 but not more than 0.95 to 2, mixing with the prepolymeric material water in the ratio of one mole of water per two isocyanate groups, and connecting the pressure vessel to the interior of the casing-enclosed activation element whereby the material in the pressure vessel foams and expands, the pressure of the forming foam causing its injection therein filling all voids in the casing-enclosed activation element and allowing the material to cure to a rigid foam.

2. The process of rendering immobile the movable or potentially movable portions of the casing-enclosed activation element of an explosive device which comprises preparing a sufficient quantity of a condensation product in a pressure vessel by reacting from 0.025 to 0.5 moles of an epoxy resin, which is itself a reaction product of epichlorohydrin and bis-phenylolpropane, with 1 mole of castor oil, reacting the reaction product formed in the preceding step with from 1.2 to 1.9 moles of an arylene diisocyanate per equivalent of hydroxyl group in said reaction product, mixing with the resulting product from 0.5 to 1.5 moles of water per free isocyanate group theoretically remaining in said resulting product, connecting said pressure vessel to the interior of said casing-enclosed activation element, whereby the material in the pressure vessel foams and expands, the pressure of the expanding foam causing its injection therein filling all voids in the casing-enclosed activation element and later allowing the foam to cure to a rigid material.

3. The method of rendering immobile the movable or potentially movable portions of a mechanism located within a casing which comprises: mixing in a pressure vessel a sufficient quantity of at least two reactants which upon mixing react to form an expanded thermosetting foam, thus creating an internal pressure; forming a perforation in the casing so as to communicate with the interior thereof; connecting the said pressure vessel to the casing at said perforation in such a manner as to retain the pressure of the expanding foam; utilizing the said pressure to cause the foam to inject itself into the casing until the casing is substantially filled therewith; and retaining the foam in the casing for a period of time sufficient to cure the foam and cause the foam to become a rigid mass, whereby the mechanism is immobilized.

4. The method of rendering immobile the movable or potentially movable components of the activating element of an explosive device such as a bomb, shell, mine, torpedo and the like comprising: mixing in a pressure vessel provided with a single opening a sufficient quantity of at least two reactants which upon mixing react to form an expanded thermosetting foam, thus creating an internal pressure within the vessel; forming a perforation in the said casing so as to communicate with the interior thereof; connecting the opening of the pressure vessel to the casing at the perforation as the foaming begins in such a manner to withhold the pressure of the expanding foam; utilizing the pressure to cause the foam to inject itself into the casing until the casing is substantially filled; and allowing the foam in the casing to cure until it becomes a rigid mass, whereby the activating element is immobilized.

* * * * *